US007766295B2

(12) United States Patent
Nilsen

(10) Patent No.: US 7,766,295 B2
(45) Date of Patent: Aug. 3, 2010

(54) SUPPORT HANGER

(75) Inventor: Martin J. Nilsen, Hampshire, IL (US)

(73) Assignee: Illinois Tool Works Inc., Glenview, IL (US)

( * ) Notice: Subject to any disclaimer, the term of this patent is extended or adjusted under 35 U.S.C. 154(b) by 136 days.

(21) Appl. No.: 12/165,878

(22) Filed: Jul. 1, 2008

(65) Prior Publication Data

US 2009/0039226 A1 Feb. 12, 2009

Related U.S. Application Data

(60) Provisional application No. 60/964,297, filed on Aug. 10, 2007.

(51) Int. Cl.
*A47H 1/00* (2006.01)

(52) U.S. Cl. ..... 248/317; 248/323; 248/327

(58) Field of Classification Search ..... 248/317, 248/323, 327, 342, 343, 222.52, 225.21; 52/741.1

See application file for complete search history.

(56) References Cited

U.S. PATENT DOCUMENTS 5,303,520 A * 4/1994 Gozdziak ..... 52/92.2
7,240,884 B2 * 7/2007 Shim ..... 248/342
7,510,160 B1 * 3/2009 Wang ..... 248/343

* cited by examiner

*Primary Examiner*—Amy J Sterling
(74) *Attorney, Agent, or Firm*—Mark W. Croll; Paul F. Donovan

(57) ABSTRACT

A support hanger system adapted to hang away from a top chord of a truss assembly using the upwardly facing planar surface of the top chord as the support surface for the downwardly extending support hanger. The support hanger assembly utilizes an elongated threaded member extending away from an operatively connected cross member. The cross member is oriented in transverse relation to the axis running along the length of the elongated threaded member. The cross member is adapted to fit through an acceptance slot extending through an upper base plate structure of the top chord such that the operatively connected threaded member extends downwardly from the upper base plate structure between downwardly projecting leg elements on either side of the acceptance slot. A channel support member adapted to reside between the leg elements may be disposed at a position below the cross member.

16 Claims, 6 Drawing Sheets

SUPPORT HANGER

CROSS REFERENCE TO RELATED APPLICATION

This Non-Provisional Application claims benefit to U.S. Provisional Application Ser. No. 60/964,297 filed Aug. 10, 2007, the contents of which are incorporated herein by reference in their entirety.

FIELD OF THE INVENTION

The present invention relates generally to support hangers and, more particularly, to a support hanger adapted to hang away from a top chord of a support truss assembly.

BACKGROUND OF THE INVENTION

Support trusses are common elements in many building environments. In particular, such trusses are often used to support roofs in buildings with expansive open interiors. Such support trusses commonly incorporate a first arrangement of beam structures referred to as "Top Chords" disposed generally in a first plane and a second arrangement of beam structures referred to as "Bottom Chords" disposed generally in a second plane below the first plane. The top chords and the bottom chords are connected by struts which extend in a pattern between the first plane and the second plane to distribute forces throughout the truss assembly. The top chords and the bottom chords of the truss assembly may be arranged in staggered relation relative to one another.

In many environments of use it may be desirable to hang structures from the truss assembly. By way of example only, exemplary hanging structures may include light fixtures, electrical outlet boxes, display signs and the like. The top chords of the truss assembly typically incorporate a generally planar upper plate structure defining a base with a pair of legs extending away from the upper plate structure. Thus, the top chord does not present a downwardly projecting support surface which can be readily used for supporting a hanging structure. Although the edges of the top chord may be used to support hanging structures, such practices may apply an undesirable torque to the truss assembly.

SUMMARY OF THE INVENTION

The present invention provides advantages and alternatives over the prior art by providing a support hanger system adapted to hang away from a top chord of a truss assembly using the upwardly facing planar surface of the top chord as the support surface for the downwardly extending support hanger.

According to one exemplary feature, the support hanger assembly utilizes an elongated threaded member extending away from an operatively connected cross member. The cross member is oriented in transverse relation to the axis running along the length of the elongated threaded member to define a substantially T-shaped profile. The cross member is adapted to fit through an acceptance slot extending through an upper base plate structure of the top chord such that the operatively connected threaded member extends from the upper base plate structure between downwardly projecting leg elements on either side of the acceptance slot. Following insertion of the cross member through the upper base plate structure, the cross member may thereafter be rotated to a transverse position relative to the acceptance slot to prohibit withdrawal. A box frame channel support member may be disposed in surrounding relation to the threaded member at a position below the cross member. The channel support member may be adapted to lock the cross member into transverse orientation relative to the acceptance slot following rotation.

Other features and advantages of the invention will become apparent to those skilled in the art upon review of the following detailed description, claims and drawings in which like numerals are used to designate like features throughout the various views.

Figure 1:
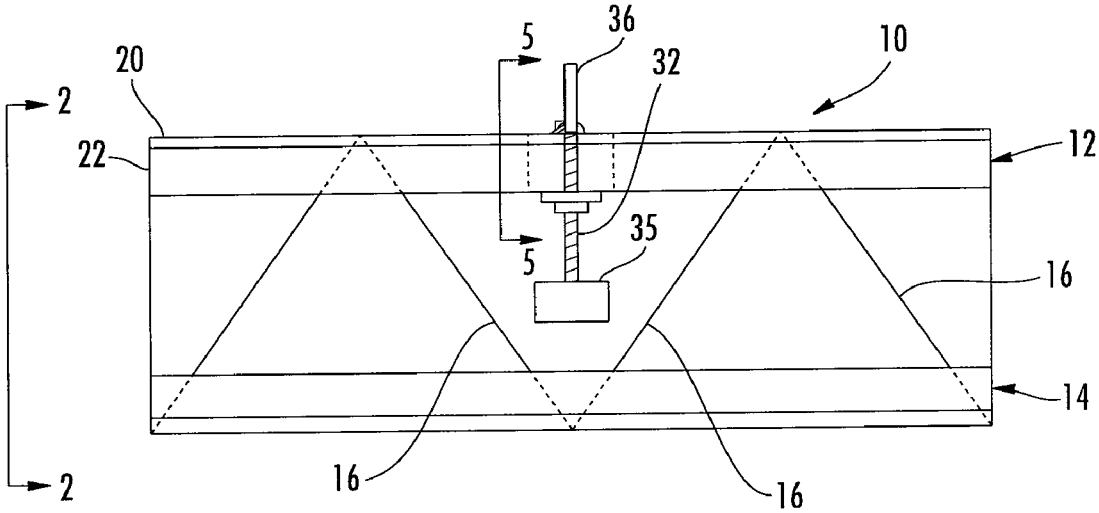
FIG. 1 is a diagrammatic side view of a truss assembly with a support hanger assembly extending away from a top chord of the truss assembly.

Before the embodiments of the invention are explained in detail, it is to be understood that the invention is not limited in its application to the details of construction and the arrangement of the components set forth in the following description or illustrated in the drawings. The invention is capable of other embodiments and of being practiced or of being carried out in various ways. Also, it is to be understood that the phraseology and terminology used herein are for the purpose of description and should not be regarded as limiting. The use of "including" and "comprising" and variations thereof is meant to encompass the items listed thereafter and equivalence thereof as well as additional items and equivalents thereof.

DETAILED DESCRIPTION OF THE PREFERRED EMBODIMENTS

Figure 2:
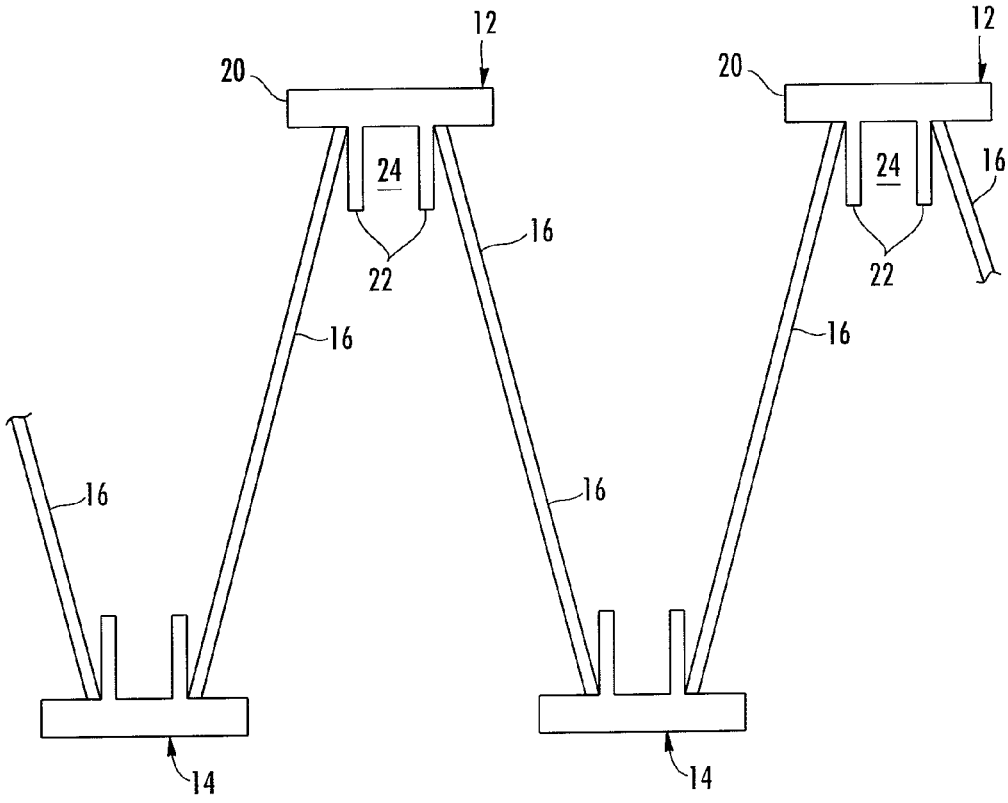
FIG. 2 is a diagrammatic view taken generally along lines 2-2 in FIG. 1 illustrating an exemplary arrangement of top chords and bottom chords forming a portion of the truss assembly of FIG. 1.

Turning now to the drawings, in FIGS. 1 and 2 there is illustrated an exemplary truss assembly 10 such as may be used to support a roof across a building structure (not shown). As will be appreciated by those of skill in the art, the illustrated truss assembly 10 includes an arrangement of top chords 12 disposed generally within an upper plane and an arrangement of bottom chords 14 disposed generally within a lower plane in vertically spaced-apart relation from the upper plane. Struts 16 extend in a defined pattern between the top chords 12 and the bottom chords 14. The struts 16 serve to distribute load across the truss assembly 10. Of course, the arrangement illustrated in FIG. 2 is exemplary only and the present invention is in no way limited for use in such an arrangement. Rather, it is contemplated that the present invention may be used in conjunction with any number of alternative truss assembly constructions as may be desired. By way of example only, while multiple top chords 12 and bottom chords 14 are illustrated, the present invention is likewise adapted for use in a truss assembly having a single top chord and bottom chord if desired.

According to one contemplated practice, the top chords 12 and the bottom chords 14 may have a substantially similar construction but with opposing orientations. By way of example only, and not limitation, one typical geometry and orientation for the top chords 12 and the bottom chords 14 is illustrated in FIG. 2. As illustrated in FIG. 2, the exemplary top chords 12 may utilize a configuration including an upper base structure 20 having a substantially planar geometry with a pair of downwardly extending legs 22 projecting generally away from the upper base structure 20. The downwardly extending legs 22 may run continuously or intermittently along the length of the upper base structure 20 to define an arrangement of upper acceptance channels 24 for acceptance of a support hanger assembly 30 (FIG. 3) as will be described further hereinafter. As shown, the exemplary bottom chords 14 may utilize a substantially similar configuration but with an inverted orientation. Of course, different configurations may likewise be utilized if desired.

Figure 3:
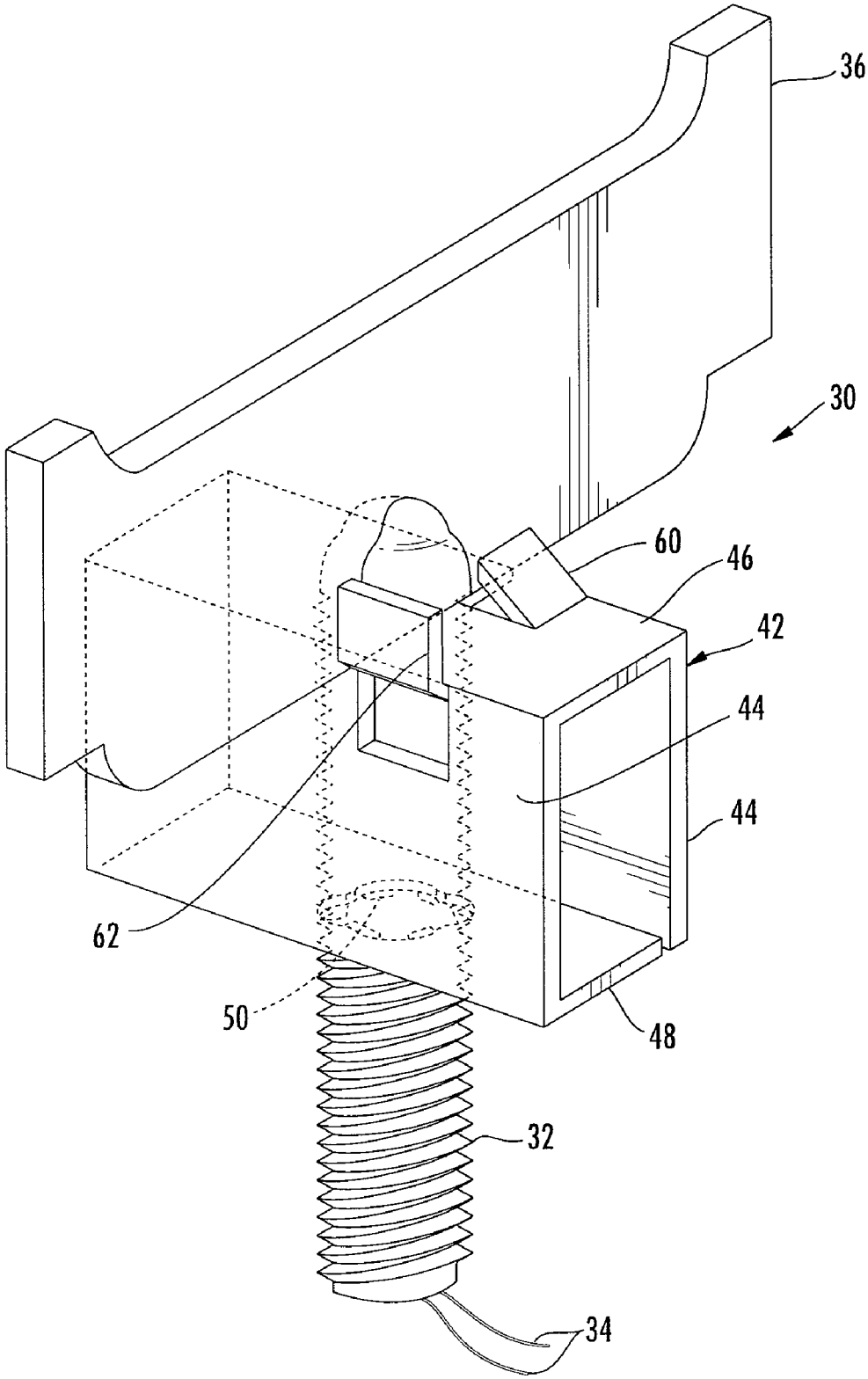
FIG. 3 is a diagrammatic perspective view of an exemplary support hanger assembly adapted to operatively engage a planar base of a top chord in a truss assembly.
Figure 5:
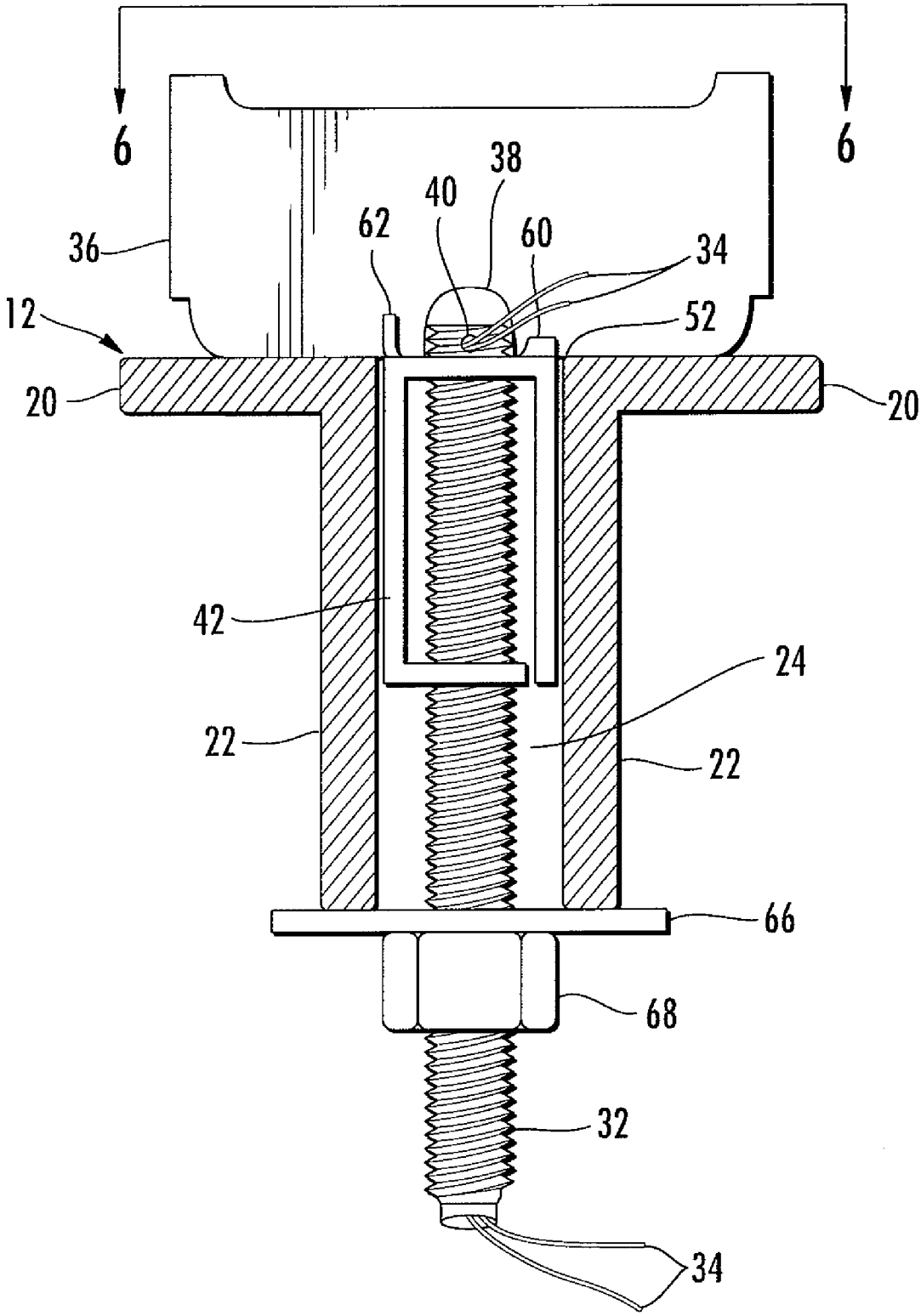
FIG. 5 is a view similar to FIG. 4 taken generally along line 5-5 in FIG. 1, showing the cross member of the support hanger assembly rotated in transverse relation to the slot opening to block withdrawal.

Referring to FIG. 3, an exemplary support hanger assembly 30 is illustrated. The support hanger assembly 30 may be used to provide hanging support to elements extending away from the top chords 12 using the upper base structure 20 as a supporting surface. As illustrated, the exemplary support hanger assembly 30 includes an elongate threaded member 32 such as a threaded tube, rod, or the like. In the event that a hollow member such as a threaded tube or the like is utilized, the elongate threaded member 32 may define a conduit for wires 34 or other elements as may be desired running within the interior. The wires 34 or other elements running along the interior of the elongate member 32 may define service connections for fixtures such as a light fixture 35 (FIG. 1), electrical outlet or other element as may be supported at the elongate member 32. As shown in FIG. 5, the elongate threaded member 32 may include a service connection access opening 40 near the proximal end for acceptance of the wires 34 or other elements to be carried at the interior of the elongate threaded member 32. Of course, the elongate threaded member 32 may also be solid if desired.

Figure 4:
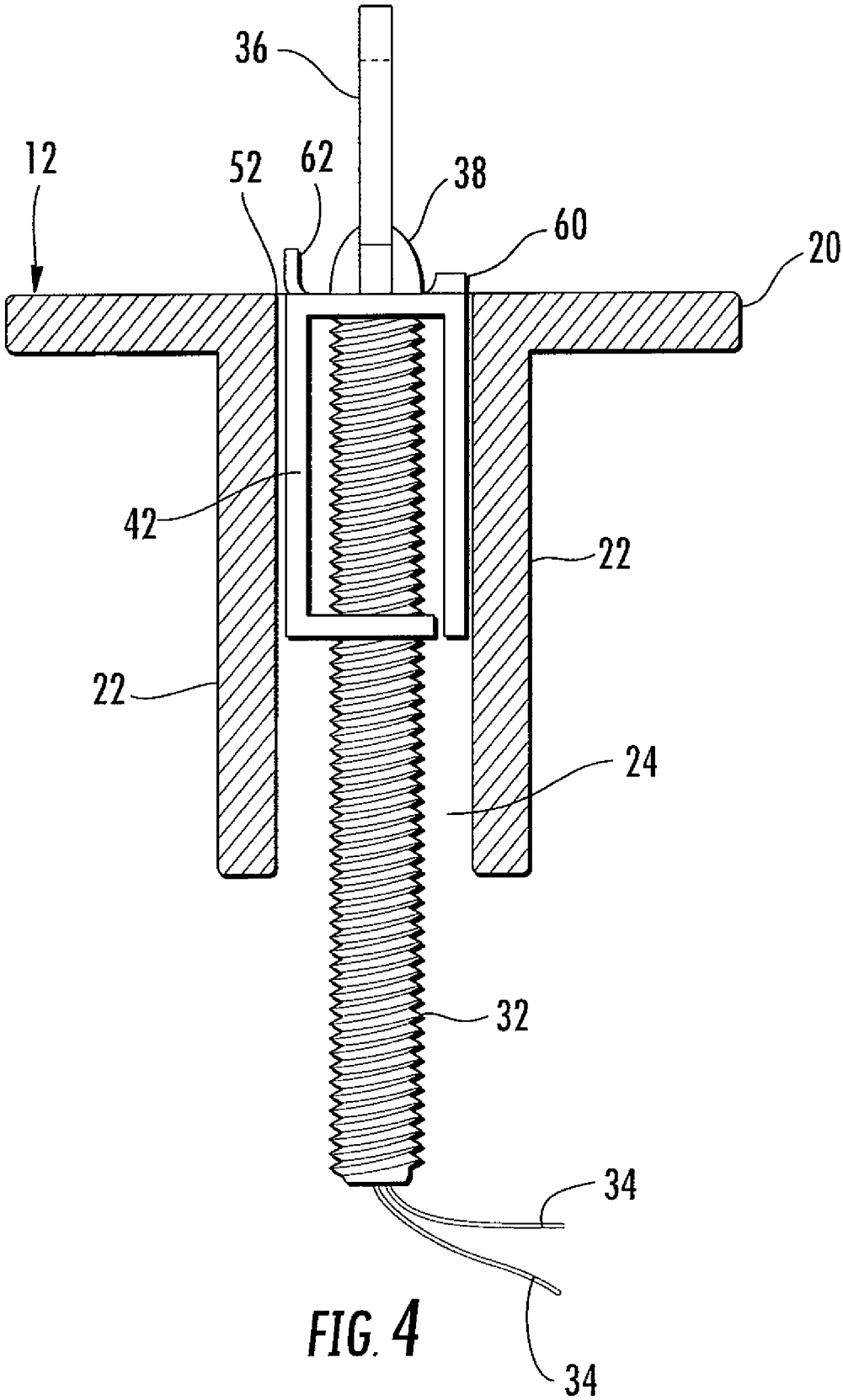
FIG. 4 is a schematic cross-sectional view illustrating the support hanger assembly of FIG. 3 with the cross member of the support hanger assembly in inserted relation through a slot opening within the planar base of a top chord within the truss assembly of FIG. 1.

As best illustrated through joint reference to FIGS. 3-5, the exemplary support hanger assembly 30 includes a cross member 36 operatively connected in transverse relation to a proximal end of the elongate threaded member 32 to define a substantially T-shaped cross section relative to the longitudinal axis of the elongate threaded member 32. By way of example only, and not limitation, the cross member 36 may be affixed to the elongate threaded member 32 by a weld connection 38 (FIG. 4) or other attachment mechanism as may be desired. The cross member 36 may have any number of configurations. However, in general, it will preferably be characterized by a length dimension greater than a width dimension. By way of example only, and not limitation, one exemplary construction for the cross member 36 illustrated in the various figures is a relatively thin blade configuration wherein the width or thickness dimension is substantially less than the length dimension. In the illustrated and exemplary configuration, the cross member 36 also has a relatively large height dimension which is substantially greater than the width dimension to facilitate ease of grasping by a user. Of course, other constructions may be used if desired.

As illustrated, in the exemplary arrangement the support hanger assembly 30 also includes a channel support member 42. As best seen in FIGS. 4 and 5, the channel support member 42 is configured to reside within an upper acceptance channel 24 formed between the downwardly extending legs 22 of a top chord 12. In the illustrated and the exemplary arrangement, the channel support member 42 may be of a substantially box frame construction including a generally hollow interior surrounded by an arrangement of boundary walls. By way of example only, such an arrangement may be formed by bending or other fabrication techniques utilizing relatively thin gauge metal sheet stock. According to one exemplary practice, the channel support member 42 may be fabricated from 0.048 inch thickness steel stock formed into a generally rectangular tube. However, other materials and thicknesses may likewise be utilized. As shown, the exemplary rectangular construction may incorporate a pair of generally planar sidewalls 44 adapted to reside in juxtaposed relation to the interior portions of the downwardly extending legs 22 in the top chord 12. The exemplary rectangular construction channel support member 42 may also include an upper wall 46 and a lower wall 48 extending substantially between the sidewalls 44.

In the illustrated exemplary arrangement, the upper wall 46 and the lower wall 48 may include opposing through holes 50 (only one shown) adapted for acceptance of the elongate threaded member 32. As best seen in FIG. 3, the through holes 50 may include an arrangement of protrusions projecting radially inwardly to engage the threads of the elongate threaded member 32. The elongate threaded member 32 may be threaded or push fit into position. In either event, the elongate threaded member is prevented from slipping out of position. Of course, other arrangements may likewise be utilized if desired.

The general construction of the cross member 36 characterized by a length dimension greater than a width dimension permits the cross member 36 to be inserted through an acceptance slot opening 52 in the upper base structure 20 and to then be rotated into an orientation with the length dimension transverse to the acceptance slot to block against subsequent withdrawal. FIG. 4 illustrates the cross member 36 in inserted relation through the acceptance slot opening 52 which may be formed through the upper base structure 20 along the length dimension of the top chord 12 at a position between the downwardly extending legs 22. As shown in FIG. 4, the cross member 36 may be oriented in general alignment with the slot opening 52 for the initial insertion. As shown, the acceptance slot opening 52 may have a width adequate to also permit passage of the upper wall 46 of the channel support member 42.

In the illustrated exemplary construction, the channel support member 42 may include a ramp member 60 and a stop tab member 62 each projecting generally away from the upper wall 46. According to one contemplated practice, both the ramp member 60 and the stop tab member 62 may be formed as cut-outs from the material forming the channel support member 42. Such formation may be carried out by relatively simple cutting and bending procedures. However, it is likewise contemplated that the ramp member 60 and/or the stop tab member 62 may be formed independently from the material forming the channel support member 42 if desired.

In the arrangement illustrated, the ramp member 60 and the stop tab member 62 are oriented generally adjacent to opposing side walls 44 of the channel support member 42. The ramp member 60 includes a sloped surface extending in angled relation away from the plane defined by the upper wall 46 to a terminal edge normally disposed in elevated relation to the plane defined by the upper wall. The direction of the ramp member 60 may be substantially parallel to the side walls 44.

Figure 6:
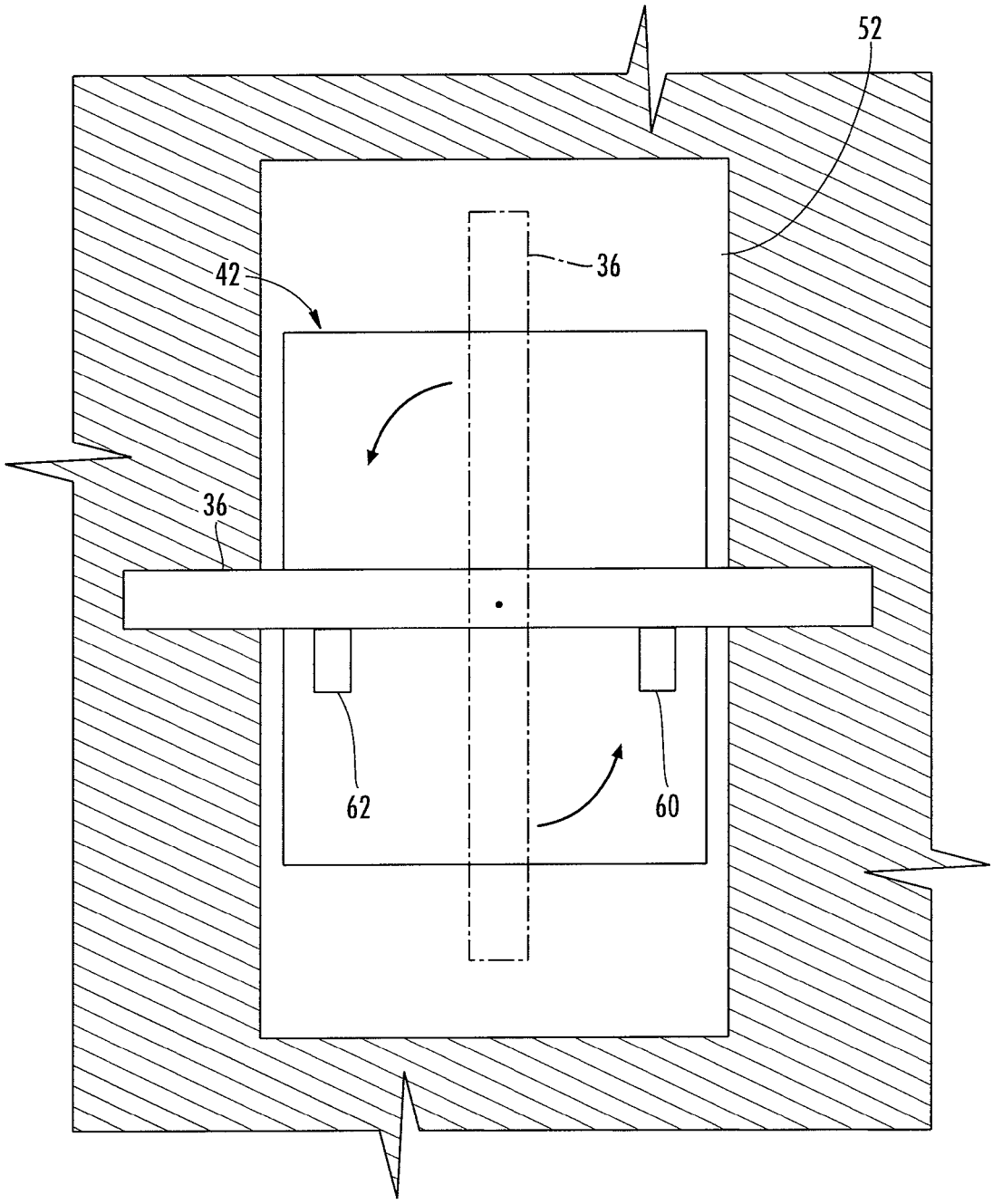
FIG. 6 is a diagrammatic plan view taken generally along line 6-6 in FIG. 5 illustrating rotation of the cross member from the orientation of FIG. 4 in phantom to the orientation of FIG. 5 in solid lines.

As will be understood through joint reference to FIGS. 3 through 6, the ramp member 60 and the stop tab member 62 may cooperatively lock the cross member 36 into a position in transverse orientation to the acceptance slot 52. In this regard, the cross member 36 along with a portion of the upper wall 46 including the outwardly projecting ramp member 60 and the stop tab member 62 may be inserted through the acceptance slot 52 in a manner as illustrated in FIG. 4. Following this insertion, the cross member 36 may be rotated so as to cause one side of the cross member 36 to engage and pass over the sloped surface of the ramp member 60. This rotation simultaneously moves an opposing side of the cross member 36 towards the stop tab member 62. This staged rotation is best illustrated in FIG. 6 showing rotation of the cross member 36 from the orientation of FIG. 4 in phantom to the orientation of FIG. 5 in solid lines. Once the cross member 36 passes beyond the terminal edge of the ramp member 60, it is thereafter blocked from substantial further rotation by the stop tab member 62 as shown in FIGS. 3 and 5. Likewise, in this orientation, the cross member 36 is blocked against reversing rotation by the trailing edge of the ramp member 60. According to one exemplary practice, the ramp member 60 may be substantially resilient such that it defines a resilient leaf spring which collapses towards the plane defined by the upper wall 46 during passage of the cross member 36 and then springs back to the elevated condition once the cross member 36 has passed. However, other constructions may likewise be utilized if desired.

As will be appreciated, during rotation of the cross member 36, the elongate threaded member may also rotate. However, the channel support member 42 will preferably remain blocked against substantial rotation by engagement between the side walls 44 and the opposing legs 22 of the top chords 12. Thus, both the ramp member 60 and the stop tab member 62 may remain in substantially stationary positions.

Once the cross member 36 is in position in crossing relation to the acceptance slot 52, the structure may be further stabilized by applying a tensioning force axially along the threaded member 32 so as to pull the elongate threaded member 32 and operatively connected cross member 36 in a generally downward direction. By way of example only, and not limitation, one exemplary arrangement for applying such stabilizing tensioning force is illustrated in FIG. 5. In this illustrated arrangement, a thrust plate 66 having an opening (not shown) is disposed about the elongate threaded member 32 at a position below the channel support member 42. The thrust plate 66 is positioned in transverse relation to the upper acceptance channel 24 at a position below the downwardly extending legs 22 such that the thrust plate 66 is in abutting engagement against the terminal edges of the downwardly extending legs 22. With the thrust plate 66 in the desired position, a tensioning nut 68 may be treaded onto the elongate threaded member 32 and advanced to the position as illustrated in FIG. 5. When the tensioning nut reaches the thrust plate 66, further advancement is blocked by the abutting engagement between the thrust plate 66 and the terminal edges of the downwardly extending legs 22. Upon reaching this blocked position, additional tightening has the effect of urging the elongate threaded member 32 in a downward direction thereby also pulling the cross member 36 downwardly and stabilizing the locked orientation. Of course, other tensioning techniques may likewise be utilized if desired. In this tightened condition and with the cross member 36 blocked against rotation or withdrawal through the acceptance slot 52, the support hanger assembly 30 provides a stable hanging support for a light fixture 35 or other element which may be operatively connected to the elongate threaded member as may be desired.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A support hanger assembly adapted to extend downwardly from a top chord of a truss, wherein said top chord includes a base having an upper surface and a lower surface, an acceptance slot opening extending through said base, and a pair of legs projecting away form said lower surface adjacent opposing lateral sides of said acceptance slot opening to define a channel between said legs, said at least one acceptance slot opening having an opening length and an opening width, the support hanger assembly comprising:

an elongate threaded member including a first end and a second end;

a cross member operatively connected to said first end of the elongate threaded member in transverse relation to an axis running between the first end and the second end, said cross member including a length dimension greater than a width dimension, said cross member being adapted for insertion through said acceptance slot opening when said length dimension is substantially aligned with said opening length, and said cross member being adapted for rotation following said insertion such that said length dimension of said cross member spans said opening width in supported relation across said upper surface; and a channel support member of box frame construction disposed at a position along said elongate threaded member at a position below said cross member, said channel support member being adapted to reside in substantially non-rotatable relation within said channel between said legs when said cross member is inserted through said acceptance slot opening, wherein said channel support member is disposed in at least partially surrounding relation to said elongate threaded member said channel support member including an upper wall, a lower wall and a pair of substantially opposing side walls extending between said upper wall and said lower wall, and wherein said channel support member includes a ramp member projecting outwardly from a plane defined by said upper wall and a stop tab member projecting outwardly from said plane defined by said upper wall, said ramp member being adapted for passage of said cross member over said ramp member in a predefined direction during rotation of said cross member, said ramp member being disposed adjacent a first one of said substantially opposing side walls and said stop tab member being disposed adjacent a second one of said substantially opposing side walls.

2. The support hanger assembly as recited in claim 1, wherein said cross member further includes a height dimension greater than said width dimension.

3. The support hanger assembly as recited in claim 1, wherein at least one of said upper wall and said lower wall includes a through hole adapted to receive a portion of said elongate threaded member, said through hole including perimeter surface projections adapted to engage threads of said elongate threaded member.

4. The support hanger assembly as recited in claim 1, wherein said ramp member includes a sloped surface extending in angled relation away from the plane defined by said upper wall to a terminal edge normally disposed in elevated relation to the plane defined by said upper wall and wherein said sloped surface extends in a direction substantially parallel to at least one of said substantially opposing side walls.

5. The support hanger assembly as recited in claim 1, wherein at least one of said ramp member and said stop tab member is formed from an integral cutout of said channel support structure.

6. The support hanger assembly as recited in claim 1, wherein each of said ramp member and said stop tab member is formed from an integral cutout of said channel support structure.

7. The support hanger assembly as recited in claim 1, wherein said ramp member is formed from an integral cutout of said channel support structure and includes a sloped surface extending in angled relation away from the plane defined by said upper wall to a terminal edge normally disposed in elevated relation to the plane defined by said upper wall, said ramp member defining a resilient spring structure adapted to collapse towards the plane defined by said upper wall during passage of said cross member and to rebound upon completion of said passage.

8. The support hanger assembly as recited in claim 1, wherein said elongate threaded member is hollow along at least a portion of its length and defines a conduit for elements extending along an interior portion of said elongate threaded member.

9. A support hanger assembly adapted to extend downwardly from a top chord of a truss, wherein said top chord includes a base having an upper surface and a lower surface, an acceptance slot opening extending through said base, and a pair of legs projecting away form said lower surface adjacent opposing lateral sides of said acceptance slot opening to define a channel between said legs, said at least one acceptance slot opening having an opening length and an opening width, the support hanger assembly comprising:

an elongate threaded member including a first end and a second end;

a cross member operatively connected to said first end of the elongate threaded member in transverse relation to an axis running between the first end and the second end, said cross member including a length dimension greater than a width dimension, said cross member being adapted for insertion through said acceptance slot opening when said length dimension is substantially aligned with said opening length, and said cross member being adapted for rotation following said insertion such that said length dimension of said cross member spans said opening width in supported relation across said upper surface;

a channel support member of box frame construction disposed at a position along said elongate threaded member at a position below said cross member, said channel support member including an upper wall, a lower wall and a pair of substantially opposing side walls extending between said upper wall and said lower wall, said channel support member being adapted to reside in substantially non-rotatable relation within said channel between said legs when said cross member is inserted through said acceptance slot opening, said channel support structure including a ramp member projecting outwardly from a plane defined by said upper wall and a stop tab member projecting outwardly from said plane defined by said upper wall, said ramp member being adapted for passage of said cross member over said ramp member in a predefined direction during rotation of said cross member, said ramp member being disposed adjacent a first one of said substantially opposing side walls and said stop tab member being disposed adjacent a second one of said substantially opposing side walls;

a thrust member disposed in surrounding relation to said elongate threaded member at a position below said channel support member, said thrust member being adapted to extend in spanning relation across said channel in abutting relation to terminal ends of said legs; and a tensioning nut disposed at a position below said thrust member, said tensioning nut being adapted to urge said thrust member towards said terminal ends of said legs and to pull said elongate threaded member downwardly.

10. The support hanger assembly as recited in claim 9, wherein said cross member further includes a height dimension greater than said width dimension.

11. The support hanger assembly as recited in claim 9, wherein at least one of said upper wall and said lower wall includes a through hole adapted to receive a portion of said elongate threaded member, said through hole including perimeter surface projections adapted to engage threads of said elongate threaded member.

12. The support hanger assembly as recited in claim 9, wherein said ramp member includes a sloped surface extending in angled relation away from the plane defined by said upper wall to a terminal edge normally disposed in elevated relation to the plane defined by said upper wall and wherein said sloped surface extends in a direction substantially parallel to at least one of said substantially opposing side walls.

13. The support hanger assembly as recited in claim 9, wherein at least one of said ramp member and said stop tab member is formed from an integral cutout of said channel support structure.

14. The support hanger assembly as recited in claim 9, wherein each of said ramp member and said stop tab member is formed from an integral cutout of said channel support structure.

15. The support hanger assembly as recited in claim 9, wherein said ramp member is formed from an integral cutout of said channel support structure and includes a sloped surface extending in angled relation away from the plane defined by said upper wall to a terminal edge normally disposed in elevated relation to the plane defined by said upper wall, said ramp member defining a resilient spring structure adapted to collapse towards the plane defined by said upper wall during passage of said cross member and to rebound upon completion of said passage.

16. The support hanger assembly as recited in claim 9, wherein said elongate threaded member is hollow along at least a portion of its length and defines a conduit for elements extending along an interior portion of said elongate threaded member.

* * * * *